US006019638A

United States Patent [19]

Saka et al.

[11] Patent Number: 6,019,638

[45] Date of Patent: Feb. 1, 2000

[54] ELECTRICAL CONNECTOR

[75] Inventors: Yukinori Saka; Masamitsu Chishima; Satomi Seko, all of Yokkaichi, Japan

[73] Assignee: Sumitomo Wiring Systems, Ltd., Japan

[21] Appl. No.: 09/187,016

[22] Filed: Nov. 6, 1998

[30] Foreign Application Priority Data

Nov. 7, 1997 [JP] Japan ..... 9-306024

[51] Int. Cl.[7] ..... H01R 13/66

[52] U.S. Cl. ..... 439/620; 439/470

[58] Field of Search ..... 439/470, 473, 439/466, 465

[56] References Cited

U.S. PATENT DOCUMENTS 5,348,494 9/1994 Falossi et al. ..... 439/447
5,586,902 12/1996 Hopf et al. ..... 439/352
5,762,520 6/1998 Martin et al. ..... 439/470

FOREIGN PATENT DOCUMENTS 2297002 7/1996 United Kingdom .

*Primary Examiner*—Neil Abrams
*Assistant Examiner*—J. F. Duverne
*Attorney, Agent, or Firm*—Banner & Witcoff, Ltd.

[57] ABSTRACT

An electrical connector can be fitted with either an electric wire cover (40) or a component installation cover (30), the choice of cover corresponding to the presence or absence of an electrical component (39) in the corresponding connector housing. The electric wire cover (40) or the component installation cover (30) are installed detachably and, as a result, the relatively expensive connector housing (10) is provided with shared components which can be adapted to the intended use.

15 Claims, 6 Drawing Sheets

ELECTRICAL CONNECTOR

TECHNICAL FIELD

The present invention relates to an electrical connector.

BACKGROUND TO THE INVENTION

An air bag circuit of an automobile contains male and female connector housings which mutually fit together, either one of the male or female of these connector housings containing ferrite for the purpose of noise reduction. In the usual case, the fitting portions of the male and female connectors have the same specification. However, there is a possibility that the specifications are not the same, depending on whether the ferrite is housed in the male or female connector housing. In these circumstances, when the male connector and the female connector, having differing production patterns, are fitted together, two types of connector housings are produced, those which are able to contain ferrite and those which are not, in order to correspond to the presence or absence of ferrite in the corresponding connector housing. By this means one can avoid the waste of having ferrite within both the male and female connectors, or the problem of having ferrite in neither the male or female connector.

In general, the shape of connector housings is complicated due to the fact that they must house terminal fittings, and consequently moulding cost are relatively high. Moreover, in the case of conventional connectors, in the case where the connector is adapted to the corresponding connector which does or does not contain ferrite, two types of connector housings must be produced, one for containing ferrite and the other not. Consequently, there is the problem that production costs rise, and confusion may be possible due to the number of different mouldings. The present invention has been developed after taking the above problem into consideration, and aims to present a connector housing in which the connectors have common features, and in which costs are reduced.

SUMMARY OF THE INVENTION

According to the invention, there is provided an electrical connector comprising a housing, an electrical terminal in the housing, and an electrical wire joined to said terminal, said housing having a wire guiding portion defining an aperture through which the wire is guided from the interior of the housing to the exterior thereof, said guiding portion being adapted externally to receive one of several tubular covers for said wire, each of said covers having one end internally adapted to said guiding portion, and said covers having a different internal volume to accommodate or not accommodate an auxiliary component.

Such a connector is adapted to receive a cover chosen according to the presence or absence of an auxiliary component, such as a cylinder of ferrite material. In this way the relatively expensive connector housing is common, and several relatively inexpensive covers can adapt this connector housing to a desired installation requirement.

Preferably the covers comprise half-shells adapted to be connected about the protruding wire, this facilitating assembly and inspection. In the preferred embodiment the half-shells of each respective cover are symmetrical and identical; this reduces the number of possible components still further.

DESCRIPTION OF DRAWINGS

Other features of the invention will be apparent from the following description of a preferred embodiment shown by way of example only with reference to the accompanying drawings in which.

DESCRIPTION OF PREFERRED EMBODIMENT

Figure 1:
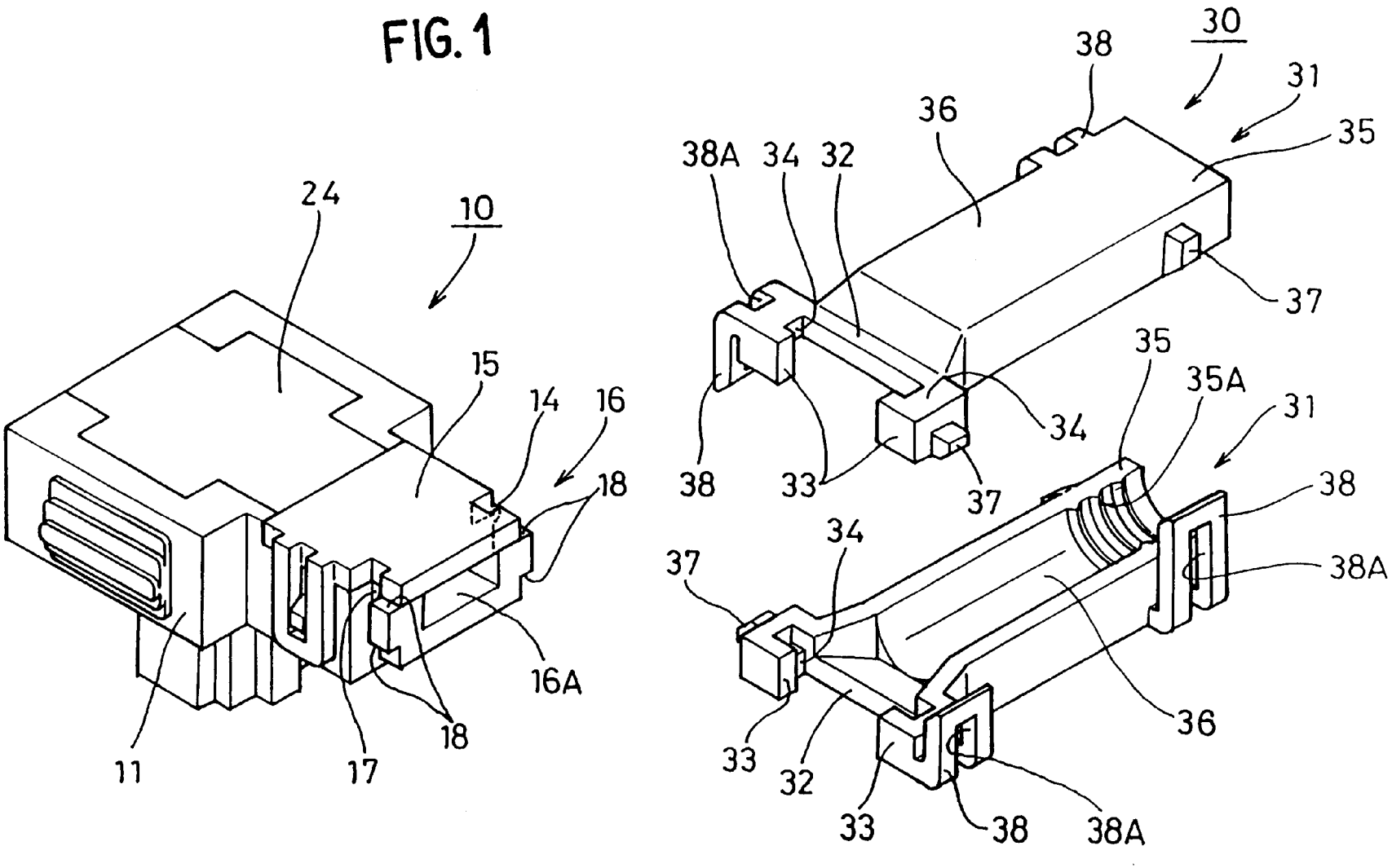
FIG. 1 is a diagonal view of a first embodiment showing a housing and a component installation cover in a disassembled state.
Figure 2:
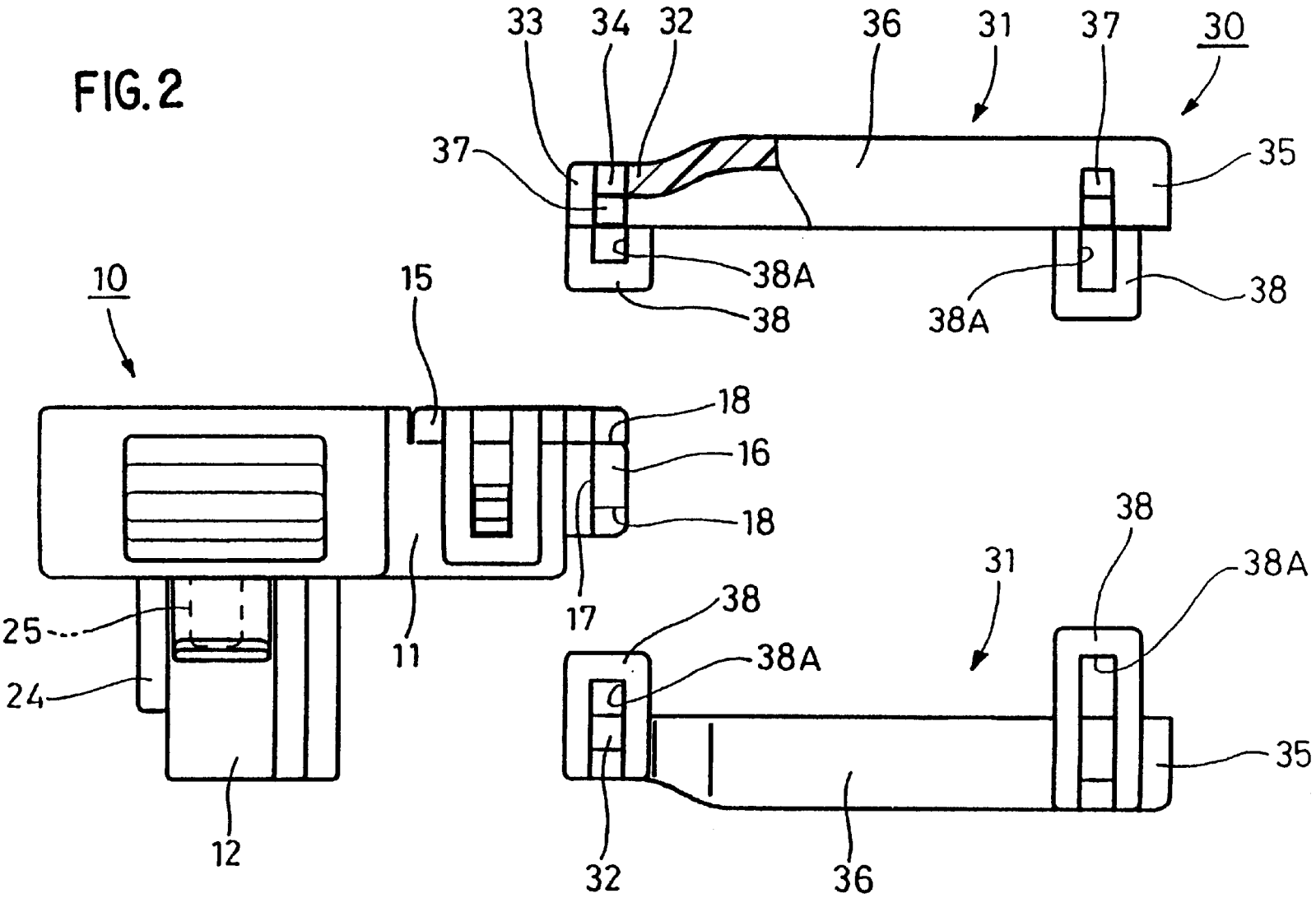
FIG. 2 is a partially cut away side face view of the first embodiment showing the housing and the component installation cover in a disassembled state.
Figure 3:
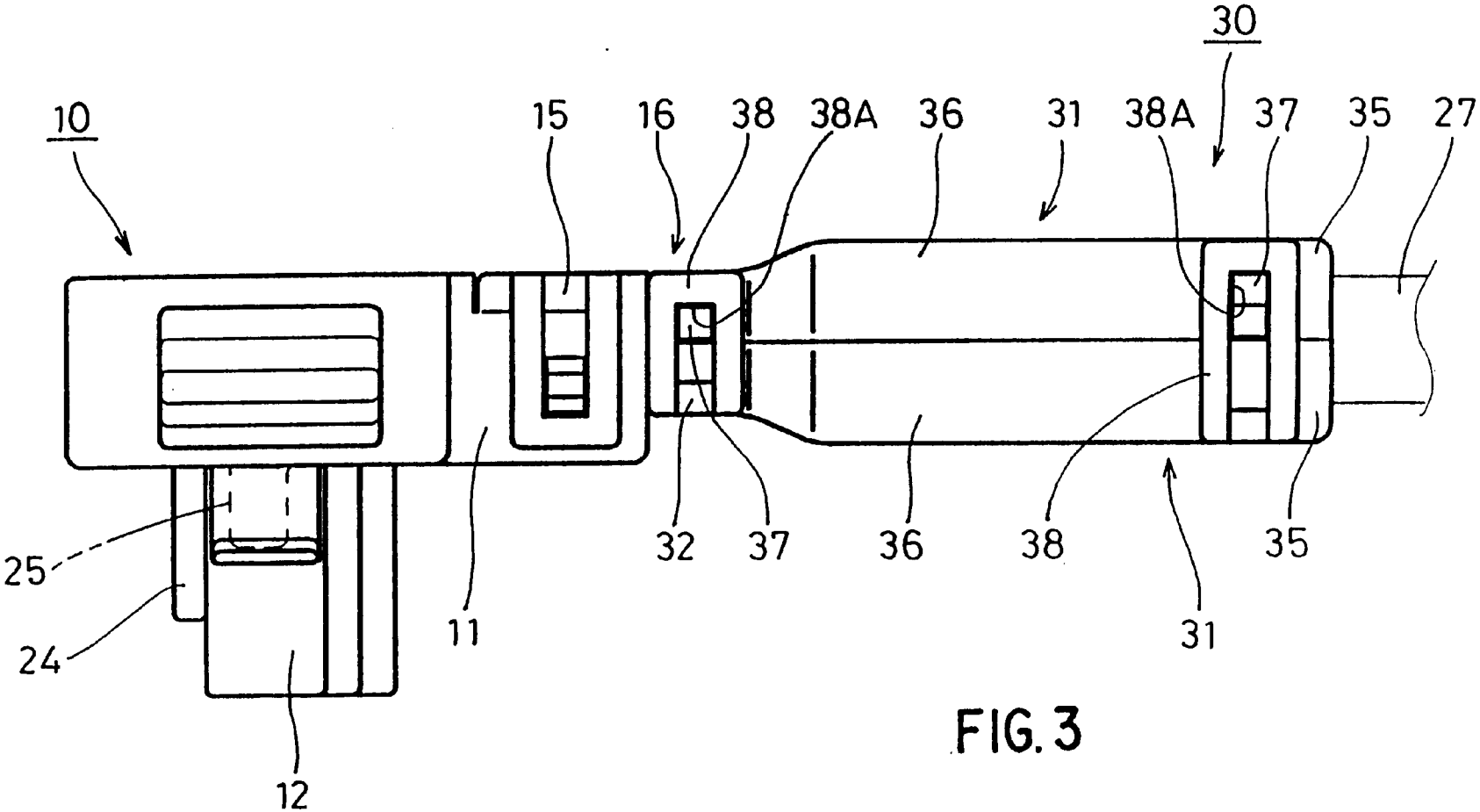
FIG. 3 is a side face view showing the housing and the component installation cover in an attached state.
Figure 4:
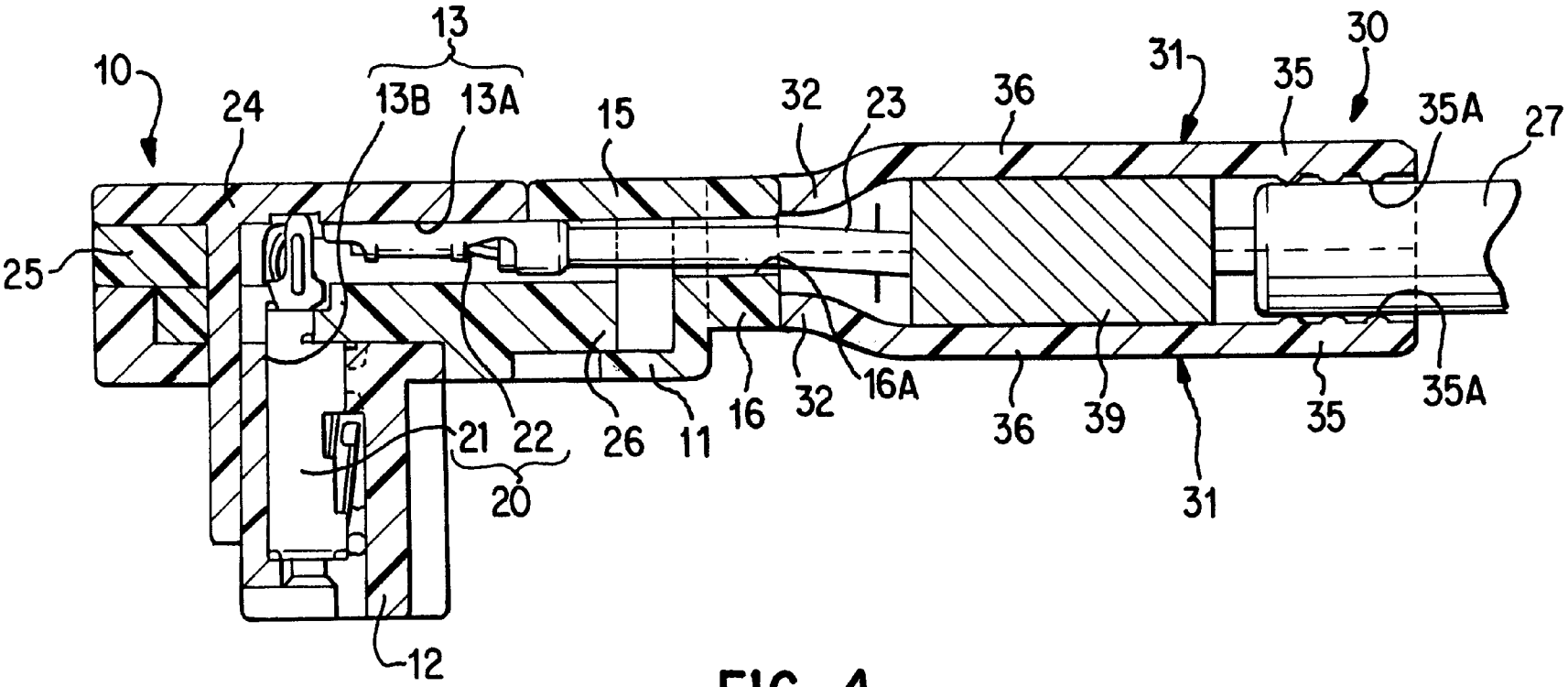
FIG. 4 is a cross-sectional view showing the housing and the component installation cover in an attached state.
Figure 5:
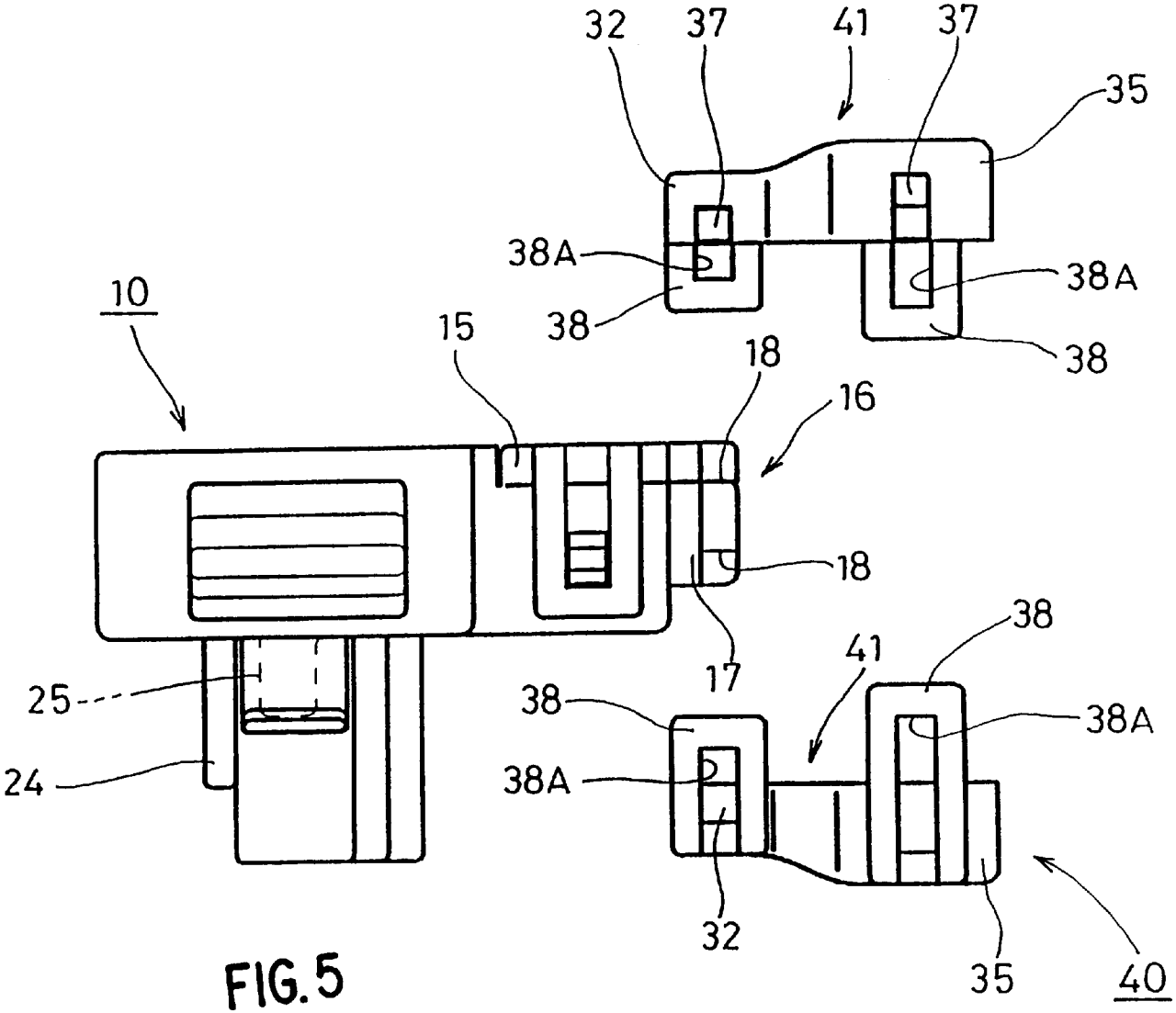
FIG. 5 is a side face view showing the housing and the electric wire cover in a disassembled state.
Figure 6:
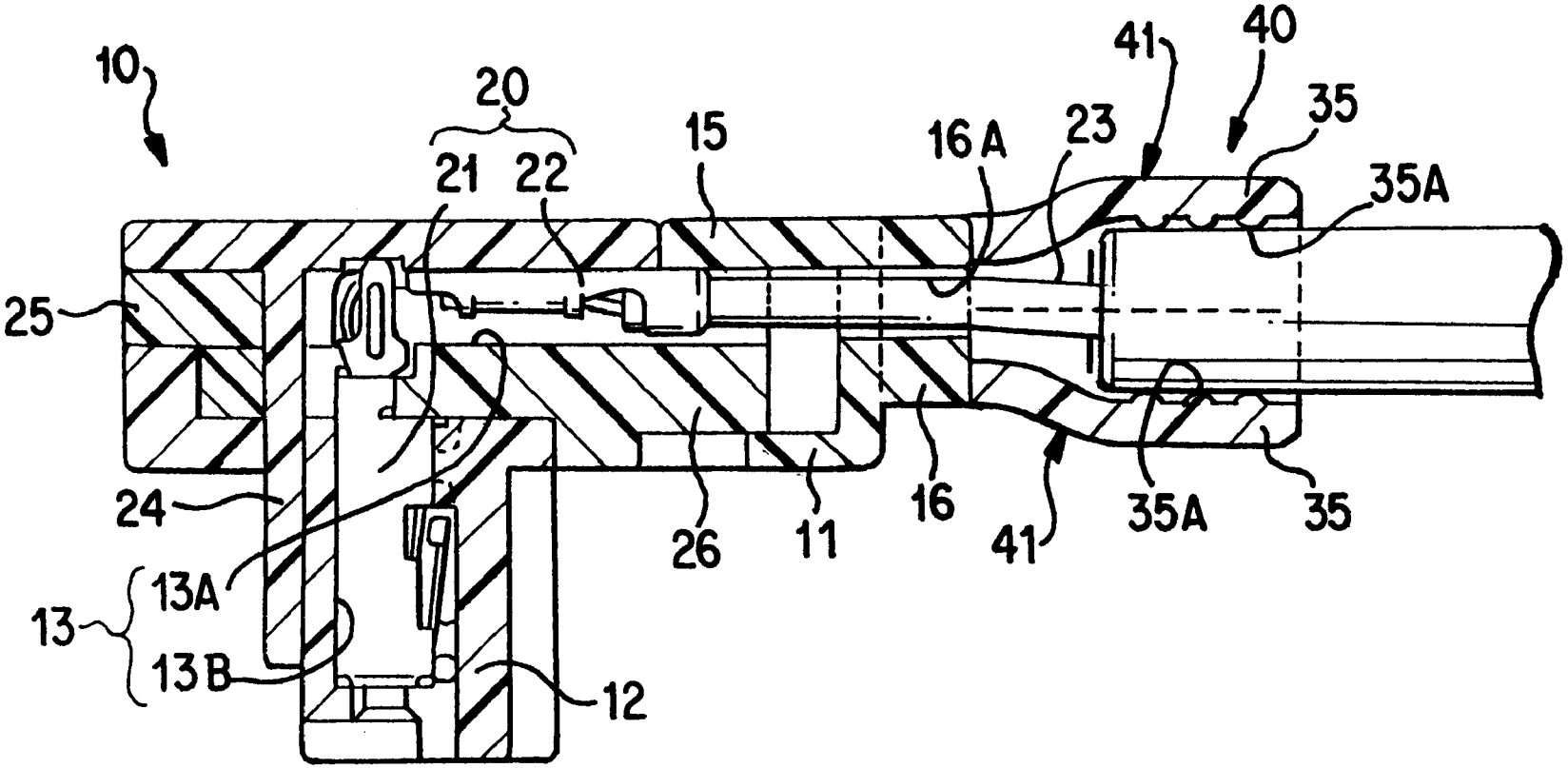
FIG. 6 is a cross-sectional view showing the housing and the electric wire cover in an attached state.

The housing 10 comprises a housing main body 11, a female terminal fitting 20, a retainer 26, a short-circuit cancelling member 24 and a fitting detecting member 25. A fitting member 12 protrudes downwards from the housing main body 11 and fits within a hood of a corresponding connector housing (not shown). A terminal housing chamber 13 which houses the female terminal fitting 20 is formed within the housing main body 11, this terminal housing chamber 13 comprising an upper space 13A which is open on its upper face, and a lower space 13B which joins at a right angle with the fitting member 12 from the anterior edge of the upper space 13A.

The female terminal fitting 20 is L-shaped and comprises a box-like terminal connecting member 21 which connects with male tabs (not shown) of the corresponding connector housing, and an electric wire connecting member 22 which crimps an electric wire 23. The terminal connecting member 21 is housed within the lower space 13B and the electric wire connecting member 22 is housed within the upper space 13A. After the female terminal fitting 20 has been housed, it is maintained in the correct attached state by the retainer 26 which is installed within the housing main body 11.

A detailed explanation is omitted, but when the short-circuit cancelling member 24 is installed in the correct position of the housing main body 11 during a fitted state with the corresponding connector housing, this short-circuit cancelling member 24 cancels the short-circuit of the male tabs (not shown) of the corresponding connector housing. Furthermore, the fitting detecting member 25 installed within the housing main body 11 detects whether the corresponding connector housing has been installed correctly.

At the posterior end of the housing main body 11, the open face of the upper space 13A is covered by a covering plate 15 which is supported on the housing main body 11 via a hinge 14, and the posterior end portion of the housing main body 11 forms an electric wire guiding member 16. An electric wire guiding hole 16A is open in the posterior end face of the electric wire guiding member 16, this electric wire guiding hole 16A joining with the upper space 13A and guiding the electric wire 23. Either the component installation cover 30 or the electric wire cover 40 can be installed on the electric wire guiding member 16.

The electric wire guiding member 16 is described in detail next. A pair of installation grooves 17 are formed on the left and right outer side faces of the electric wire guiding member 16, these installation grooves 17 being located slightly to the anterior of the posterior end face and being formed by cutting away in an up-down direction. Moreover, stoppers 18 are also formed on the left and right outer side faces of the electric wire guiding member 16 at a location posterior to the installation grooves 17, the upper and lower ends of each stopper 18 being cut away in a stepped shape, as illustrated. Further, in size and in form, the electric wire guiding member 16 is symmetrical above and below and to the left and right.

Next, the component installation cover 30 and the electric wire cover 40 are explained.

The component installation cover 30 comprises a pair of semitubular members 31 which are identical in shape and which join together to form a tubular shape. The anterior end portions of the semitubular members 31 form installation members 32 which join with the electric wire guiding member 16. A pair of hook members 33 protrude from the left and right edges of the installation members 32 and form a U-shape when seen from above (from the outer face). The anterior ends of the hook members 33 fit with the installation grooves 17 of the electric wire guiding member 16. Further, stopping members 34 located at approximately the innermost side of the U-shape of the hook members 33 project inwards and fit together with the stoppers 18. The installation members 32 fit together from above with the upper half of the electric wire guiding member 16 and from below with the lower half of the electric wire guiding member 16. Furthermore, the height of the installation members 32 is one half that of the electric wire guiding member 16 and so, when installed, the upper and lower faces of the installation members 32 and the hook members 33 form a single face with the upper and lower faces of the electric wire guiding member 16. In this way, the left and right of the installation members 32 are symmetrical with the electric wire guiding member 16.

Along the length in an anterior-posterior direction of each semitubular member 31, and adjoining the installation member 32, the inner face of the semitubular member 31 forms a semitubular shape having a semicircular circumference face. The posterior end of the interior of this semitubular portion has a plurality of protruding bands 35A extending along the inner circumferential face in the direction of the circumference, these forming an electric wire supporting member 35. A resilient protective layer 27 which surrounds the electric wire 23 fits with this electric wire supporting member 35, the protruding bands 35A pressing into the external face of the protective layer 27 and thus regulating its movement relative to the electric wire supporting member 35. Moreover, the portion extending between the electric wire supporting member 35 and the installation member 32 comprises a component housing member 36. The component housing member 36 houses tubular-shaped ferrite 39 which is known for its function in reducing noise after the electric wire 23 has been inserted. The dimensions of the ferrite 39 are such that its external diameter is close to the internal diameter of the component housing member 36.

Furthermore, the semitubular members 31 are provided with a stopping means to maintain them in a joined state. That is, stopping protrusions 37 are formed on the left exterior side face of the installation member 32 and the left exterior side face of the electric wire supporting member 35, and resilient stopping members 38, formed on the right exterior side face of the installation member 32 and the right exterior side face of the electric wire supporting member 35, extend along these faces and protrude towards the corresponding semitubular member 31. Each resilient stopping member 38 is provided with a stopping groove 38A which fits with the stopping protrusion 37 of the corresponding semitubular members 31 when these are in a joined state, the stopping groove 38A thereby maintaining the joined state of the semitubular members 31.

The electric wire cover 40 is made from a pair of semitubular members 41, each semitubular member 41 being identical in shape and comprising an installation member 32, an electric wire supporting member 35, a stopping protrusion 37 and a resilient stopping member 38. These installation members 32, electric wire supporting members 35, stopping protrusions 37, and resilient stopping members 38 are identical in shape with the installation members 32, electric wire supporting members 35, stopping protrusions 37 and resilient stopping members 38 of the component installation cover 30 mentioned above. That is, the electric wire cover 40 lacks the component housing member 36 of the component installation cover 30, and the anterior-posterior dimensions of the electric wire cover 40 are correspondingly shorter. Consequently, identical configuration and parts have been assigned the same numbers as those of the component installation cover 30, and a detailed explanation of the electric wire cover 40 is omitted.

Next, the operation of the present embodiment are explained. In the case where ferrite used for noise reduction is not provided within a corresponding connector housing, noise reduction is carried out by installing the ferrite 39 and the component installation cover 30 within the housing 10. When the component installation cover 30 is to be installed, the ferrite 39 and the protective layer 27 are first positioned so as to encase the electric wire 23, and the pair of semitubular members 31 of the component installation cover 30 join together from above and below so as to surround the ferrite 39 and the protective layer 27.

At this juncture, the hook members 33 of the installation members 32 fit together with the installation grooves 17, and the stopping members 34 are stopped by the stoppers 18. When the semitubular members 31 are fitted together, the stopping grooves 38A of the resilient stopping members 38 engage the stopping protrusions 37, thereby locking the component installation cover 30 in a joined state and fixing it within the housing 10.

In this installed state, the stopping of the hook members 33 by the installation grooves 17 regulates the movement of the component installation cover 30 in an anterior-posterior direction and a left-right direction relative to the housing 10. Further, the stopping of the stopping members 34 by the stoppers 18 regulates the movement of the component installation cover 30 in an up-down direction relative to the housing 10. Moreover, the ferrite 39 is housed within the component housing member 36 and, within the electric wire supporting member 35 the protruding bands 35A press into the external face of the protective layer 27, thereby regulating its movement in an anterior-posterior direction and providing protection for the electric wire at a distance from the housing 10.

When the component installation cover 30 is to be removed from the housing 10 the resilient stopping members 38 are bent outwards and become separated from the stopping protrusions 37, and the two semitubular members 31 can be separated into their upper and lower halves.

Further, in the case where ferrite is provided within the corresponding connector housing, there is no need to provide the ferrite 39 within the housing 10 and, consequently, the electric wire cover 40 is installed on the housing 10. Installation and removal of the electric wire cover 40 is carried out in the same manner as for the component installation cover 30 described above, and therefore a detailed description thereof is omitted. In the installed state, the stopping of the hook members 33 by the installation grooves 17 regulates the movement of the electric wire cover 40 in an anterior-posterior direction and a left-right direction, and the stopping of the stopping members 34 by the stoppers 18 regulates the movement of the electric wire cover 40 in an up-down direction. Moreover, within the electric wire supporting member 35, the protruding bands 35A press into the external face of the protective layer 27 and thus regulate its movement in an anterior-posterior direction at a distance from the housing 10.

In the conventional case, the housing 10 is complicated in shape and moulding costs are relatively high. The present embodiment presents two kinds of covers, the electric wire cover 40 and the component installation cover 30, these being simple in shape and having relatively low moulding costs. They correspond to the presence or absence of ferrite in the corresponding connector housing and enable costs to be reduced.

Furthermore, when the component installation cover 30 or the electric wire cover 40 is to be installed on the housing 10, the pair of semitubular members 31 or 41 can be joined together to enclose the electric wire 23 and the ferrite 39, or to enclose only the electric wire 23. Consequently, compared to the case in which the electric wire is inserted through a cylindrical cover, operability is improved.

Moreover, the pairs of semitubular members 31 and 41 which join together have an identical form and are symmetrical along their anterior-posterior axis. Consequently, compared to the case in which both semitubular members have differing configurations, there is a lesser number of components, and costs are reduced. Further, unlike the case in which differing semitubular members have to be joined together, the time-consuming process of correctly fitting together the semitubular members 31 and 41 is eliminated, and operability is thus improved.

The present invention is not limited to the embodiments described above with the aid of figures. For example, the embodiments described below also lie within the technical range of the present invention. In addition, the present invention may be embodied in various other ways without deviating from the scope thereof.

In the embodiment described above, both the electric wire cover and the component installation cover comprise a pair of semitubular members which join together symmetrically along an axial direction to form an identical shape. However, according to the present invention, either or both of the covers may equally well comprise asymmetrical semitubular members.

In the embodiment described above, either the electric wire cover or the component installation cover is attached to or detached from one female connector. However, according to the present invention, this may equally well be one male connector, or both male and female connectors. In the case where the covers are to be attached to or detached from both male and female connectors, the cover of the male or female side may have a common shape, and therefore only three types of components will be needed.

The above embodiment explains a case suitable for a connector provided with a fitting detecting function and a short-circuit cancelling function. However, the present invention can also be suitable for different connectors as well.

The above embodiment explains a case suitable for using noise-reducing ferrite as the electric wire installation component. However, the cover 40 is also suitable for housing materials other than ferrite.

We claim:

1. An electrical connector assembly comprising a housing, an electrical terminal in the housing, an electrical wire joined to said terminal, and a plurality of covers for attaching to the housing, only one of which is attached to the housing at a time, said housing having a tubular wire guiding portion defining an aperture through which the wire is guided out of the housing, said guiding portion having first coupling structures on an exterior thereof, and each of said covers having second coupling structures on one end which are adapted to attach to the first coupling structures to secure the respective cover to the housing having a wire extending from the aperture, said covers each having a hollow interior with a different internal volume such that one of the covers encloses only a portion of the wire and one of the covers encloses a portion of the wire and another electrical component.

2. The electrical connector assembly according to claim 1 wherein said covers each comprise half-shells adapted to be joined together to form a tubular shape.

3. The electrical connector assembly according to claim 2 wherein said half-shells of a respective cover are symmetrical.

4. The electrical connector assembly according to claim 2 wherein said second coupling structures each include a releasable snap-fitting latch for retaining said half-shells in said tubular shape.

5. The electrical connector assembly according to claim 3 wherein said said second coupling structures each include a releasable snap-fitting latch for retaining said half-shells in said tubular shape.

6. The electrical connector assembly according to claim 4 wherein each cover includes a releasable snap-fitting latch on a second end opposite said one end.

7. The electrical connector assembly according to claim 6 wherein each cover includes a releasable snap-fitting latch on a second end opposite said one end.

8. The electrical connector assembly according to claim 1 wherein said first and second coupling structures include anti-rotation means to prevent relative rotation between said guiding portion and said covers.

9. The electrical connector assembly according to claim 1 wherein said covers include internal circumferential ribs for gripping said wire.

10. The electrical connector assembly according to claim 1, wherein each said cover accommodates said wire with minimal free space.

11. The electrical connector assembly according to claim 1, wherein said another electrical component includes a tubular ferrite component positioned about said wire.

12. The electrical connector assembly according to claim 2 wherein said first coupling structures further include an installation groove and each second coupling structure includes a member for positioning within said groove to control the movement of its respective cover relative to said housing in a direction generally parallel to the wire extending through the cover.

13. The electrical connector assembly according to claim 12 wherein said first coupling structures include stops and each second coupling structure includes a member for contacting said stops to limit the movement of its respective half-shell toward the other half-shell.

14. The electrical connector assembly according to claim 4 wherein each second coupling structure includes a stopping member for cooperating with said releasable latch member.

15. The electrical connector assembly according to claim 14 wherein said releasable latch member includes a groove for receiving said stopping member.

* * * * *